US006643867B2

(12) United States Patent
Silverman et al.

(10) Patent No.: US 6,643,867 B2
(45) Date of Patent: Nov. 11, 2003

(54) FAUCET STAND

(75) Inventors: Jerome Louis Silverman, Boca Raton, FL (US); Robert Howard Mayer, Delray Beach, FL (US)

(73) Assignee: Deco Lav, Inc., Delray Beach, FL (US)

( * ) Notice: Subject to any disclaimer, the term of this patent is extended or adjusted under 35 U.S.C. 154(b) by 0 days.

(21) Appl. No.: 10/104,438

(22) Filed: Mar. 22, 2002

(65) Prior Publication Data

US 2003/0177573 A1 Sep. 25, 2003

(51) Int. Cl.[7] ..... E03C 1/00

(52) U.S. Cl. ..... 4/696; 4/695; 4/630; 4/643

(58) Field of Search ..... 4/696, 695, 630, 4/632, 633, 634, 643–649, 624, 625; 137/359; 211/22, 33, 37, 40, 41.1, 41.3, 41.7, 41.8, 133.1, 133.3

(56) References Cited

U.S. PATENT DOCUMENTS

| | | | | | |
|---|---|---|---|---|---|
| 19,694 | A | * | 3/1858 | Gies | 4/631 |
| 827,278 | A | * | 7/1906 | Wilkison | 4/625 |
| 998,742 | A | * | 7/1911 | Berkeley | 4/646 |
| 1,409,255 | A | * | 3/1922 | Smith | |
| 1,499,495 | A | * | 7/1924 | Windsor | 4/643 |
| 1,827,053 | A | * | 10/1931 | Veneman | 4/643 |
| 2,836,831 | A | * | 6/1958 | Hurwitz | |
| 2,899,137 | A | * | 8/1959 | Martin | |
| 3,292,966 | A | * | 12/1966 | Mariol | 4/631 |
| 4,369,532 | A | * | 1/1983 | Houchins et al. | 4/639 |
| 4,542,831 | A | * | 9/1985 | Dazza | 4/643 |
| 4,674,139 | A | * | 6/1987 | Walker | 4/643 |
| 5,070,554 | A | * | 12/1991 | Bertoli | |
| 5,148,552 | A | * | 9/1992 | Kress | |
| 5,253,376 | A | * | 10/1993 | Fait | |
| 5,735,001 | A | * | 4/1998 | Bitsche | 4/631 |
| 6,212,707 | B1 | * | 4/2001 | Thompson et al. | 4/631 |
| 6,212,708 | B1 | * | 4/2001 | Mulaw | 4/657 |
| D456,065 | S | * | 4/2002 | Jones et al. | D23/293.1 |

* cited by examiner

*Primary Examiner*—Gregory L. Huson
*Assistant Examiner*—Khoa D. Huynh
(74) *Attorney, Agent, or Firm*—Fleit, Kain, Gibbons, Gutman, Bongini & Bianco; Paul D. Bianco; Martin Fleit

(57) ABSTRACT

The present invention relates to a faucet stand for positioning a faucet in operative relationship to a free-standing bowl mounted on a table or counter top. The faucet stand includes a base with a curved front surface for receiving the bowl, first and second sides extending from the base, and at least one through hole extending through the base for receiving the faucet. The faucet stand allows the use of conventional faucets with free-standing bowls thereby eliminating the need for either specially sized faucets or faucets extending from the wall.

11 Claims, 2 Drawing Sheets

FAUCET STAND

FIELD OF THE INVENTION

The present invention relates to a stand for positioning a faucet in operative relationship to a bowl functioning as a sink and mounted on a table or counter top.

BACKGROUND OF THE INVENTION

With the advent of modern plumbing, the use of washbasins rapidly became outdated and replaced with a sink supplied with running water that drained out of the house through piping. However, there is now a trend to combine the convenience of modern plumbing with the elegance of a decorative washbasin. Specifically, a bowl having a hole at or near its base is mounted on a countertop or tabletop so that the hole aligns with a drain. A faucet is located such that the water coming from the faucet flows into the bowl.

Because the bowl is mounted on the countertop and has a substantial height and diameter, faucets that are sized to be used with conventional sinks usually cannot be used with the bowl. Rather, specially sized faucets that are long enough to rise over the bowl and extend sufficiently outward so that water flows into the bowl must be used. Such specially sized faucets can be expensive and, since relatively few are available compared to the number of standard sized faucets, limit the style selection. Furthermore, unless the flow controls are located on the faucet, reaching around the bowl to access these controls is inconvenient.

As an alternative to specially sized faucets, faucets that extend from a wall near the bowl can be used. Again, this type of faucet is limited in selection and cost more than traditional faucets. More importantly, unless the bowl is being installed in new construction, there is significant added expense in placing the necessary plumbing behind the wall to accommodate a faucet extending from the wall.

Thus, there exists a need for an improved faucet stand.

SUMMARY OF THE INVENTION

The present invention relates to a faucet stand for positioning a faucet in operative relationship to a free-standing bowl mounted on a table or counter top. The faucet stand comprises a base with top, bottom, front, and back surfaces, first and second sides extending from the base, each side including front, back, top, and bottom edges, and at least one through hole extending from the top surface through the bottom surface for receiving the faucet. The front surface of the base is curved to receive the bowl.

Each side can have a length that increases from the bottom top edge to the p bottom edge. The bottom edges of the first and second sides can be configured and dimensioned so that the faucet stand is free standing on the counter top. Furthermore, the back edges of the first and second sides and the back surface of the base can be flush. In another embodiment, the first and second sides angle in toward each other.

The base and first and second sides can each be made as separate pieces, with at least a portion of the bottom surface resting on the top edges of the first and second sides. An adhesive can be used to connect the base to the first and second sides.

In one embodiment, the faucet stand has a width that is smaller than the bowl diameter. In another embodiment, a back panel extends from the back surface of the base and covers an area between the first and second sides. The bottom edges of the first and second sides can be substantially perpendicular to the respective back edges of the first and second sides.

In another exemplary embodiment, the faucet stand comprises a base with top, bottom, front, and back surfaces, with the front surface being curved to receive the bowl; first and second sides extending from the base, each side including front, back, top, and bottom edges with the front edges having an arcuate surface; and at least one through hole extending from the top surface through the bottom surface for receiving the faucet. An underside of the bowl can rest on the front edges of the first and second sides.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE EMBODIMENTS

Figure 1:
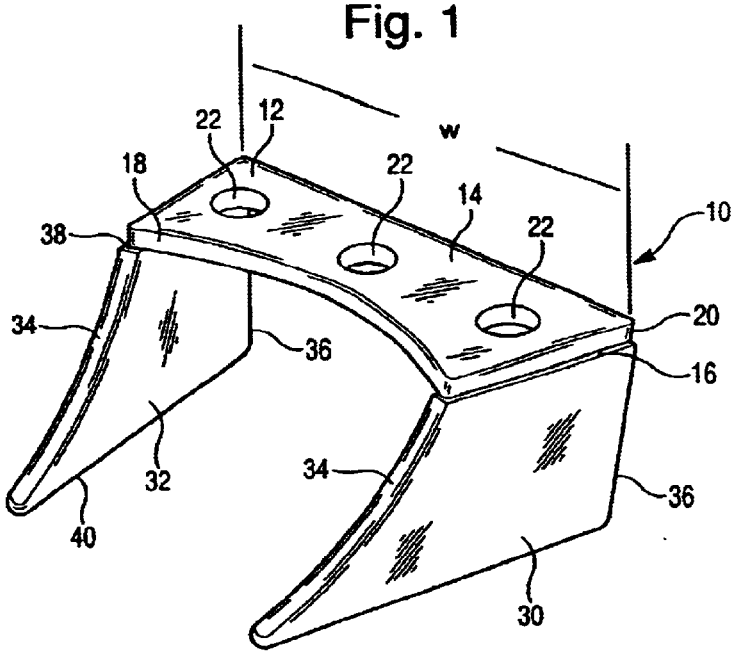
FIG. 1 shows a perspective view of one embodiment of the faucet stand according to the present invention.

For convenience, the same or equivalent elements in the various embodiments of the invention illustrated in the drawings have been identified with the same reference numerals. Further, in the description that follows, any reference to either orientation or direction is intended primarily for the convenience of description and is not intended in any way to limit the scope of the present invention thereto. Finally, any reference to a particular application is simply used for convenience as one example of a possible use for the invention and is not intended to limit the scope of the present invention thereto. For example, while the faucet stand according to the present invention is shown and described as being useful in conjunction with a free-standing bowl placed on a table or counter top, the faucet stand can be used with different plumbing fixtures and/or on different structures.

Figure 2:
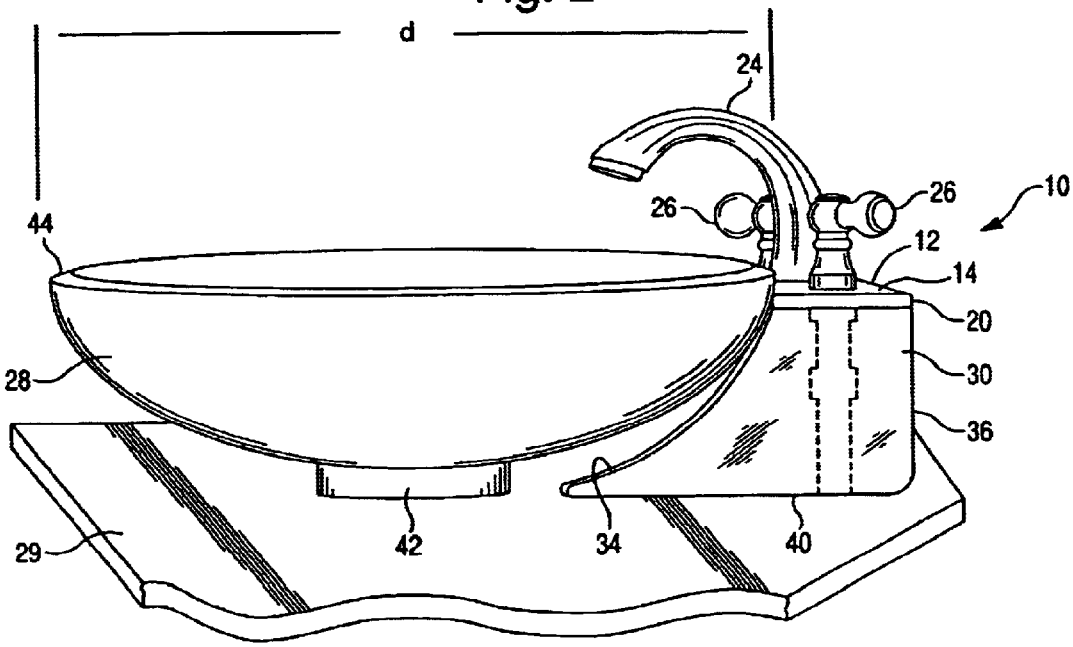
FIG. 2 shows a side view of the faucet stand of FIG. 1 installed on a table or counter top with a bowl and faucet.

FIGS. 1 and 2 show an embodiment of a faucet stand 10 according to the present invention. Faucet stand 10 includes a base 12 with top 14, bottom 16, front 18, and back 20 surfaces. Three through holes 22 extend from top surface 14 through bottom surface 16 for receiving the faucet 24 and hot and cold water controls 26. The number, size, and location of through holes 22 can be varied to suit a particular application. For example, if the faucet is provided with a single, integrated hot and cold water control, only one through hole would be needed. Furthermore, additional through holes can be provided to accommodate other fixtures, such as a soap dispenser.

Front surface 18 is curved to receive bowl 28. The fit of bowl 28 within the curvature of front surface 18 provides support for bowl 28, which is free-standing on table or counter top 29. Such support provides mechanical stability to bowl 28, which can have substantial size and weight, particularly if made of glass.

First 30 and second 32 sides extend from base 12. Each of first 30 and second 32 sides includes front 34, back 36, top 38, and bottom 40 edges. Base 12 and first 30 and second 32 sides can be made as an integral single piece unit. Alternatively, base 12 and first 30 and second 32 sides are separate pieces that are attached or otherwise coupled together. Any suitable means, such as adhesives, welding, screws or other fasteners, etc., can be used to couple base 12 to first 30 and second 32 sides. As shown in FIGS. 1 and 2, base 12 and first 30 and second 32 sides are separate pieces with at least a portion of bottom surface 20 of base 12 resting on top edges 38 of first 30 and second 32 sides.

Each of first 30 and second 32 sides has a length that increases from top edge 38 to bottom edge 40. This increase in length allows faucet stand 10 to closely mimic the shape of bowl 28, which increases in diameter from a mounting ring 42 (located on table or counter top 29) to a rim 44. The configuration of first 30 and second 32 sides, and in particular of their respective bottom edges 40, also allows faucet stand 10 to be free-standing on table or counter top 29. This enhances the stabilizing effect of faucet stand 10. Furthermore, faucet stand 10, and consequently bowl 28, can be placed substantially at any desired location on table or counter top 29. However, back edges 36 of first 30 and second 32 sides can be made flush with respect to each other so that faucet stand 10 can be placed against a wall, if desired. Additionally, bottom edges 40 of first 30 and second 32 sides can be made substantially perpendicular with the respective back edges 36, thereby forming an L-shape. One advantage of either the flush and/or L-shaped configuration is that the wall against which faucet stand 10 is placed would aid in concealing any piping supplied to faucet 24 and hot and cold water controls 26.

First 30 and second 32 sides can either be parallel with respect to each other or angle toward or away from each other. Regardless of the relative position, FIGS. 1 and 2 show that faucet stand 10 has a width "w" that can be made smaller than the maximum diameter "d" of bowl 28 (typically located at or near rim 44). Because the width of faucet stand 10 is smaller than the diameter of bowl 28, using faucet stand 10 with bowl 28 does not completely eliminate the visual effect of a free-standing bowl.

Figure 3:
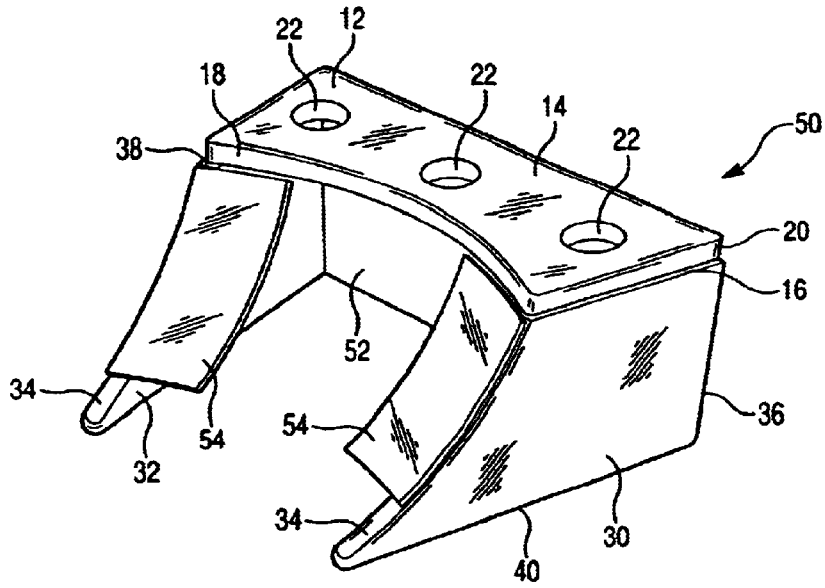
FIG. 3 shows a perspective view of another embodiment of the faucet stand according to the present invention.

FIG. 3 shows another embodiment of a faucet stand 50 according to the present invention. Faucet stand 50 and faucet stand 10 are substantially similar in structure and function. Accordingly, reference is made to the above-description for similar elements. Faucet stand 50 is provided with two additional optional elements, which can be provided either in conjunction with one another or separately. A back panel 52 is provided to assist in concealing any piping supplied to the faucet and hot and cold water controls. In this regard, side panels 54 are provided along at least a portion of front edges 34 of first and second sides 30, 32. As best seen in FIG. 2, a gap may be present between the bottom outside surface of bowl 28 and first 30 and second 32 sides. The presence and size of the gap depends on the respective geometries of bowl 28 and first 30 and second 32 sides. By providing side panels 54, at least a portion of the gap can be covered to conceal the space under base 12.

Figure 4:
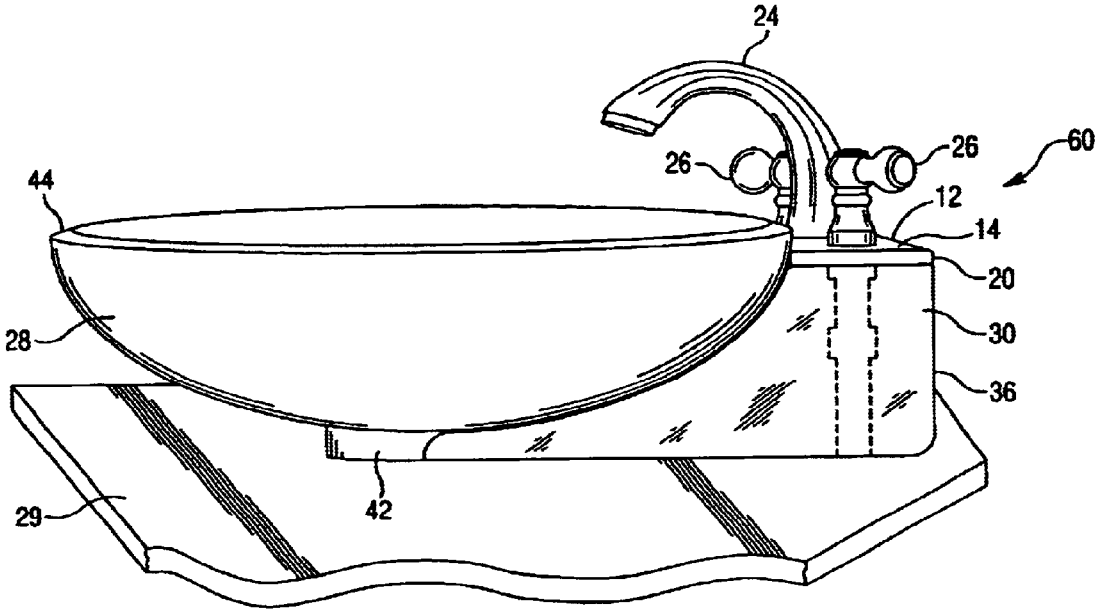
FIG. 4 shows a side view of another embodiment of the faucet stand according to the present invention installed on a table or counter top with a bowl and faucet.

FIG. 4 shows another embodiment of a faucet stand 60 according to the present invention. Faucet stands 10, 50, and 60 are substantially similar in structure and function. Accordingly, reference is made once again to the above-description for similar elements. As was the case for faucet stands 10, 50, faucet stand 60, has first 30 and second 32 sides that increase in length from bottom edge 40 to top edge 38. Furthermore, each of front edges 34 of first 30 and second 32 sides has an arcuate surface so that the underside of bowl 28 rests on front edges 34. This arrangement provides further support for bowl 28. Additionally, resting bowl 28 on front edges 34 eliminates any gap between faucet stand 60 and bowl 28.

Each of the embodiments of the faucet stand according to the present invention allows the use of conventional faucets with free-standing bowls thereby eliminating the need for either specially sized faucets or faucets extending from the wall.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A faucet stand for positioning a faucet in operative relationship to a free-standing bowl mounted on a table or counter top, the faucet stand comprising:

a base with top, bottom, front, and back surfaces, with the front surface being arcuately curved to receive the bowl;

first and second sides extending from the base, each side including front, back, top, and bottom edges; and at least one through hole extending from the top surface through the bottom surface for receiving the faucet, wherein the arcuately curved front surface supports the free-standing bowl mounted on a table or counter top.

2. The faucet stand of claim 1 wherein each side has a length that increases from the top edge to the bottom edge.

3. The faucet stand of claim 1 wherein there are three through holes.

4. The faucet stand of claim 1 wherein the bottom edges of the first and second sides are configured and dimensioned so that the faucet stand is free standing on the counter top.

5. The faucet stand of claim 1 wherein the back edges of the first and second sides and the back surface of the base are flush.

6. The faucet stand of claim 1 wherein the base and first and second sides are each separate pieces, with at least a portion of the bottom surface resting on the top edges of the first and second sides.

7. The faucet stand of claim 6 wherein an adhesive is used to connect the base to the first and second sides.

8. The faucet stand of claim 1 wherein the bowl has a diameter and the faucet stand has a width that is smaller than the bowl diameter.

9. The faucet stand of claim 1 wherein a back panel extends from the back surface of the base and covers an area between the first and second sides.

10. The faucet stand of claim 1 wherein the bottom edges of the first and second sides are substantially perpendicular to the respective back edges of the first and second sides.

11. A faucet stand for positioning a faucet in operative relationship to a free-standing bowl mounted on a table or counter top, the faucet stand comprising:

a base with top, bottom, front and back surfaces, with the front surface being arcuately curved to receive the bowl;

first and second sides extending from the base, each side including front, back, top, and bottom edges; and at least one through hole extending from the top surface through the bottom surface for receiving the faucet, wherein the first and second sides angle in toward each other.

* * * * *